United States Patent [19]

Anderson

[11] Patent Number: 4,502,523

[45] Date of Patent: Mar. 5, 1985

[54] SLATTED BLIND ASSEMBLIES HAVING AUTOMATIC OPENING AND CLOSING FEATURES

[75] Inventor: Richard N. Anderson, Owensboro, Ky.

[73] Assignee: Hunter Douglas Inc., Totowa, N.J.

[21] Appl. No.: 559,770

[22] Filed: Dec. 9, 1983

Related U.S. Application Data

[63] Continuation-in-part of Ser. No. 387,035, Jun. 10, 1982, Pat. No. 4,458,740, which is a continuation-in-part of Ser. No. 333,809, Dec. 21, 1981, abandoned.

[51] Int. Cl.[3] ..... E06B 9/26

[52] U.S. Cl. ..... 160/174; 160/107

[58] Field of Search ..... 160/107, 174, 176, 178

[56] References Cited

U.S. PATENT DOCUMENTS 2,207,605 4/1938 Wolfe .
3,389,737 6/1968 Arnold .
3,719,221 3/1973 Hanson .

FOREIGN PATENT DOCUMENTS 263181 5/1964 Australia .
2095958 2/1972 France .

*Primary Examiner*—Peter M. Caun
*Attorney, Agent, or Firm*—Pennie & Edmonds

[57] ABSTRACT

Slatted blind assembly having a mat of slats with a pivot means adapted to be fixed to a structure positioned adjacent opposite ends of the mat. A pair of cables supporting the slats extend between supporting points on the pivot means. The supporting points of each pivot means define with the center point of the pivot axis about which the pivot means rotates a triangle with the center point forming a vertex of the top angle of the triangle. The top angles of the pivot means on opposite sides of the mat face in opposite directions.

8 Claims, 6 Drawing Figures

SLATTED BLIND ASSEMBLIES HAVING AUTOMATIC OPENING AND CLOSING FEATURES

CROSS-REFERENCE TO OTHER APPLICATIONS

This application is a continuation-in-part of my copending application Ser. No. 387,035, now U.S. Pat. No. 4,458,740 filed June 10, 1982, in turn a continuation-in-part of my application Ser. No. 333,809, filed Dec. 21, 1981, now abandoned.

TECHNICAL FIELD

This invention relates to slatted blind assemblies having automatic opening and closing features and more particularly to blind assemblies which in one form will tend to tilt slats to a slat open position upon removal of a tilting force and in another form will tend to tilt slats to a slat closed position upon removal of a tilting force.

This application also relates to subject matter generally similar to subject matter disclosed in my copending application Ser. No. 384,286, filed June 2, 1982 which in turn relates to subject matter disclosed in application Ser. No. 184,060 filed Sept. 4, 1980, now abandoned, in turn a continuation of application Ser. No. 076,713 filed Sept. 19, 1979, now abandoned, in turn a continuation of application Ser. No. 953,235 filed Oct. 20, 1978, now abandoned, in turn a continuation of application Ser. No. 885,035 filed Mar. 9, 1978, now abandoned, in turn a continuation of application Ser. No. 709,869 filed July 29, 1976, now abandoned.

BACKGROUND OF THE INVENTION

Venetian blind structures are know in which a plurality of slats are supported by slat support means in the form of tape ladders extending between sill and head slats and which in turn are pivotally supported by pivot members to top and bottom frames of a window opening. For example see the structure disclosed in U.S. Pat. No. 3,389,737. In such structure the blind is constructed so that the slats will remain in any position to which they are adjusted and after removal of the adjustment force necessary to make the adjustment.

In some instances it is desirable to have a blind construction which, instead of the slats remaining in an adjusted position, will return automatically to an original preadjusted position upon removal of an adjustment force. For example, to assure privacy, it may be desirable to have a blind construction in which the slats will automatically return to a closed position upon removal of an adjustment force which tilted or adjusted the slats to an open or partially open position. In other instances it may be desirable to have the blind operate in a reverse manner, that is to have the slats automatically return to an open position upon removal of an adjustment force which tilted the slats to a closed position.

It is further desirable in order to minimize inventory requirements to keep the number of separate parts making up a blind assembly to a minimum and when possible to use standard end slats modified to have pivot members attached thereto, or in the alternative, to have unmodified end slats associated with pivot members spaced from the end slats.

It is therefore an object of my invention to provide for slatted blind assemblies having automatic opening and closing features and which require a minimum of modified or special parts making up the assemblies.

DESCRIPTION OF THE INVENTION

Basically a slatted blind assembly constructed according to my invention comprises a plurality of tiltable slats forming a mat including a first end slat on a first end of the mat and a second end slat on a second end of the mat opposite the first end. At least one pivot means is adjacent to each end of the mat and is adapted to be connected to a structure, such as a frame member, so that the pivot means pivots about a pivot axis extending parallel to the slats. Slat support means comprising a pair of cables extend between the pivot means situated on opposite ends of the mats from two supporting points on each pivot means such that pivotal movement of a pivot means will tilt each of the slats. The two supporting points on each pivot means and a center point of the pivot axis together form the vertices of a triangle with the center point forming a top vertex and the two supporting points base vertices. The top vertices of pivot means situated at opposite ends of the mat face in opposite directions. This positioning of the top vertices results in tension in the cables being at a minimum in one or more stabilized tilt positions of the slats and with the cables being subjected to an increased tension in other tilt positions of the slats tending to return the slat to a stabilized position, a stabilized position being one to which the slat will return after removal of a tilt or adjustment force.

The pivot means on one end of the slat may comprise a plurality of single pivot members in combination with an end slat at one end of the mat of slats and where the supporting points are positioned at opposite longitudinal edges of the end slat. In this form of the invention the end slat is usually modified in order that a pivot member may be fastened thereto.

Further a pair of cables is associated with each of the pivot members at each end of the mat of slats such that the cables of a pair extend between the supporting points on one pivot means on one end of the mat to the supporting points on the pivot member at the opposite end of the mat.

In a further form of the invention the pivot means may comprise a single pivot member remote and spaced from an adjacent end slat. In this instance the supporting points are formed by contacting points of the cables of a pair of cables with the pivot member so that there is a plurality of single pivot members arranged on one end of a mat each oprating with a pair of cables. In this form of the invention it is preferable that the distance between two supporting points on a pivot member substantially equal the width of a slat. Further it is preferable that there be a plurality of single pivot members positioned at the oposite end of the mat of slats also remote and spaced from an adjacent end slat with a pair of cables associated with each pivot member.

When the top angles of the pivot means positioned on each end of a slat are positioned to point in opposite directions, as explained above, so that they both point towards the mat of slats, the stabilized position, where the tension in the cables is least, is in a slat closed position. Any adjusting force applied to tilt the slats to an open position results in the center point of a line connecting the base vertices of opposite pivot means moving relatively away from each other to stretch the cables thus increasing tension in the cables. Release or removal of the tilting or adjustment force results in the cables contracting causing the slats and pivot means to tilt back to a stabilized closed or partially closed position.

When the top vertices of the pivot means are reversed, that is when they both point away from the center of the mat of slats, the stabilized position where the tension in the cables is least is a slat open position. Any adjusting force applied to tilt the slats to a closed position results in the center points of a line connecting the base vertices of opposite pivot means moving away from each other to stretch the cables thus imparting tension in the cables. Again, removal of the adjusting or tilting force allows the cables to contract thus pivoting the pivot means and tilting the slats to an open position.

The cables referred to may be cords which form a part of conventional ladder cords or any other cable-like means so long as the cables or cords have a degree of resiliency so that tension variations are possible.

A pivot means in addition may comprise one throughgoing means having a slat-like profile in the general manner as that shown in U.S. Pat. No. 3,389,737 previously mentioned. In addition a pivot means on one end of the mat of the slat could comprise a plurality of pivot members combined with an end slat while at the other end of the mat the pivot means could comprise separate pivot members remote and spaced from an end slat, the requirement being in all cases that the top vertices of the pivot means point in opposite directions.

The slatted blind assembly of the invention is applicable for use with conventional vertically arranged venetian blinds having horizontal slats as well as with blinds having slats extending vertically, blinds with inclined slats and blinds horizontally positioned for use with skylight blinds.

DESCRIPTION OF THE PREFERRED EMBODIMENTS

Figure 1:
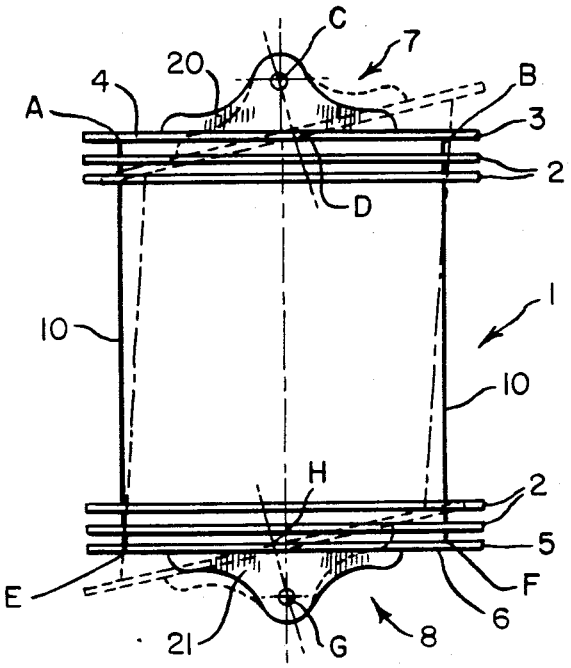
FIG. 1 is a diagrammatic sketch of a slatted blind assembly constructed according to the invention having a pivot means comprising a pivot member combined with an end slat and wherein the stabilized position is a slat open position.

Referring to the Figures in which like parts have the same identifying numerals, there is illustrated in FIG. 1 a slatted blind assembly having a mat 1 made up of a plurality of slats 2 including a first end slat 3 at a first end 4 of the mat and a second end slat 5 at a second end 6 of the mat opposite the first end. A pivot means denoted generally 7 is positioned adjacent the first end 4 of the mat and a pivot means 8 is positioned adjacent the second end 6 of the mat. Pivot means 7 and 8 are adapted to pivotally connect to a structure, not shown, as for example, top and hottom window frames. Slat support means in the form of a pair of cables 10 connect the pivot means 7 and 8 to support individual slats 2. The cables 10 of a pair of cables extend parallel on opposite sides of the slats in a plane perpendicular to the plane of mat 1 which in the Figures extends perpendicular to the plane of the sheet of drawings.

As shown in FIG. 1 the cables 10 extend between two supporting points A and B on the pivot means 7 and two supporting points E and F on the pivot means 8.

In FIG. 1 the pivot means 7 comprises a pivot member 20 in combination with end slat 3 and where the pivot means is pivotal about a pivot axis having a center point C while the pivot means 8 comprises a pivot member 21 in combination with end slat 6 with the pivot member pivotal about a pivot axis having a center point G. As seen, points A, B, and C define a triangle where the angle ACB comprises a top angle and angles BAC and CBA comprise base angles. Similarly points E, F, G define a triangle where the angle EGF comprises a top angle and angles GEF and EFG comprise base angles. As seen top angles ACB and EGF face in opposite directions towards the mat 1 such that the pivot axis of the pivot means are located outwardly of the mat.

The result of having the top angles face outwardly of the mat is that when the pivot members and end slats are tilted to the position shown in the dotted lines, a center point D of the end slat 3 connecting the points A and B will be moved upwardly. Similarly a center point H of the end slat 5 will be moved downwardly resulting in the end slats being moved apart and stretching the cables 10. Stretching of the cables increases tension in the cables such that when any tilting or adjustment force is removed, the cables will contract to ease the tension therein causing the end slats, as well as the remainder of the slats, to pivot back to the full line position where tension in the cables is at a minimum and the blind assembly is in a stabilized position.

The supporting points A, B, C and D are shown positioned near respective opposite longitudinal edges of the end slats and for practical purposes may be considered on the edges. However in practice the supporting points may be positioned inwardly a slight amount from the edges in notches formed in the end slats with similar notches formed in the remainder of the slats to allow the cables to engage in the notches so as to prevent slippage of the slats with respect to the cables.

For clarity, only one pair of cables connecting opposite pivot means is shown in the drawings. Again in practice the normal arrangement would involve a plurality of pivot means positioned along the length of each end slat with a pair of cables connecting with each pivot means.

Figure 2:
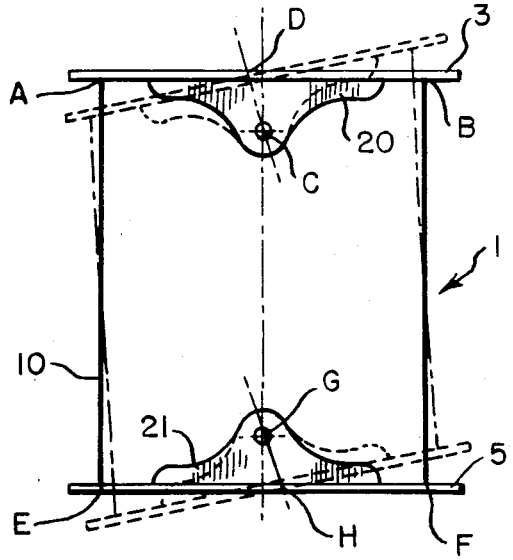
FIG. 2 is a diagrammatic sketch of a blind assembly similar to FIG. 1 wherein a stabilized position comprises a slat closed position.

Referring to FIG. 2 there is illustrated a blind assembly similar to that of FIG. 1 except that the pivot members 20 and 21 are positioned on opposite sides of the end slats from that shown in FIG. 1 such that the top angles ACB and EGF both point towards the mat 1. The effect of this construction is that when the slats are moved from a closed position shown in dotted lines to an open position shown in full lines by the application of a tilting or adjusting force, the center points D and G of the end slats are moved away from each other thus stretching the cables 10 and increasing tension therein. Release of the tilting force will allow the cables to contract reducing tension which will pivot the slats back towards a closed or partially closed position, shown in dotted line, where the assembly will be in a stabilized position. It should be noted that in this construction there can be more than one stabilized position. That is as shown in FIG. 2 the slats can pivot together from a fully open position, shown in solid line, in either a clockwise or counterclockwise direction to a fully closed position.

Figure 3:
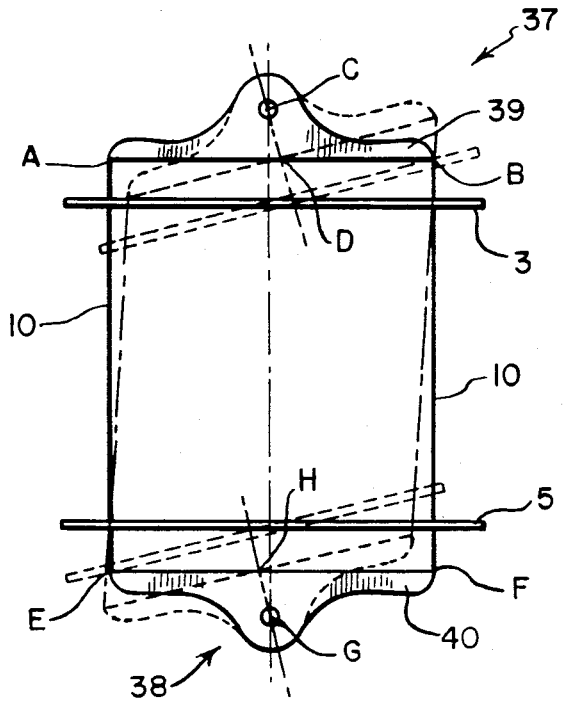
FIG. 3 is a diagrammatic sketch of a slatted blind assembly constructed according to the invention having a pivot means comprising a pivot member remote and spaced from an end slat and wherein the stabilized position is a slat open position.

Referring to FIG. 3 there is illustrated a further form of the invention in which the pivot means 37 adjacent the end 4 of the mat and the pivot means 38 adjacent the end 6 of the mat comprise pivot members 39 and 40 which are remote and spaced from the end slats 3 and 5. In this instance the supporting points A and B and supporting points E and F supporting the cables 20 lie directly on the pivot members and the distance between the points A and B and the points E and F is substantially equal to the width of the slats. This particular arrangement does not require any modification of the end slats in order to accommodate a pivot member as may be required in the construction of FIGS. 1 and 2 and to this extent reduces inventory requirements.

The pivot means 37 and 38 comprising the pivot members 39 and 40 pivot about center points D and G in the same manner as with respect to the structure of FIG. 1 and the center points along with the supporting points form triangles similar to those in FIG. 1 with the top angles ACB and EGF both pointing in opposite directions away from the mat.

The operation of the blind assembly of FIG. 3 is likewise similar to that of FIG. 1. When the pivot members are tilted by application of a tilting force from the full line open slat position to a partially closed slat position shown in dotted line, the center point D connecting points A and B and center point H connecting points E and F will be moved away from each other thus stretching and increasing tension in cables 10. Removal of the tilting force will then allow the cables to contract to move the slats back to the open stabilized position where tension in the cables is at a minimum.

Figure 4:
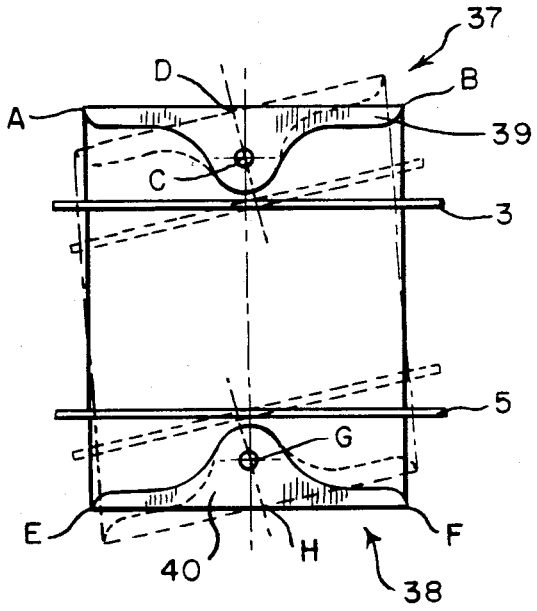
FIG. 4 is a diagrammatic sketch of a blind assembly similar to FIG. 3 wherein a stabilized position comprises a slat closed position.

The construction in FIG. 4 is similar to that shown in FIG. 3 in that the pivot means 37 and 38 comprising pivot members 39 and 40 are remote and spaced from the end slats. However, in this instance the pivot members 39 and 40 are inverted from that shown in FIG. 3 so that the top angles ACB and EGF while still facing in opposite directions both face towards the mat of slats. The operation of the blind assembly will thus be similar to that shown in FIG. 2. That is when the slats are tilted by application of a tilting or adjustment from a stabilized partially closed position shown in dotted line towards a slat open position shown in full line, the center points D and H will be moved away from each other to stretch the cables and to increase cable tension. Removal of the tilting force will allow the cables to contract thus moving the pivot members and slats towards the stabilized partially closed or fully closed position.

It is to be noted with respect to the embodiments of FIGS. 3 and 4 that the pivot members having their distances between their supporting points substantially equal to that of the width of the slat results in that pivot members act as end slats.

In the embodiments of FIGS. 1–4 the supporting points A, C, E and F also serve as contacting points where the cables are connected directly to an end slat, as with the embodiments of FIGS. 1 and 2, or directly with a pivot member as with the embodiments of FIGS. 3 and 4.

Figure 5:
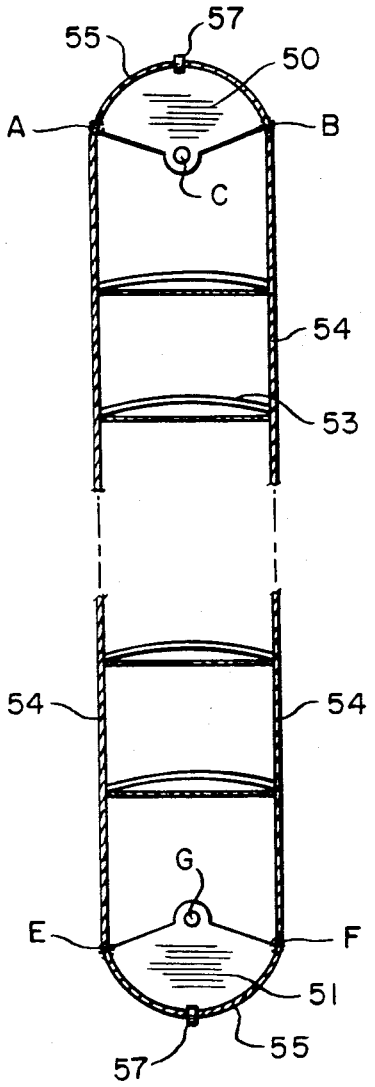
FIG. 5 is a diagrammatic sketch of a further form of blind assembly where the pivot means is spaced and remote from an end slat and with the slats in an open unstabilized position.
Figure 6:
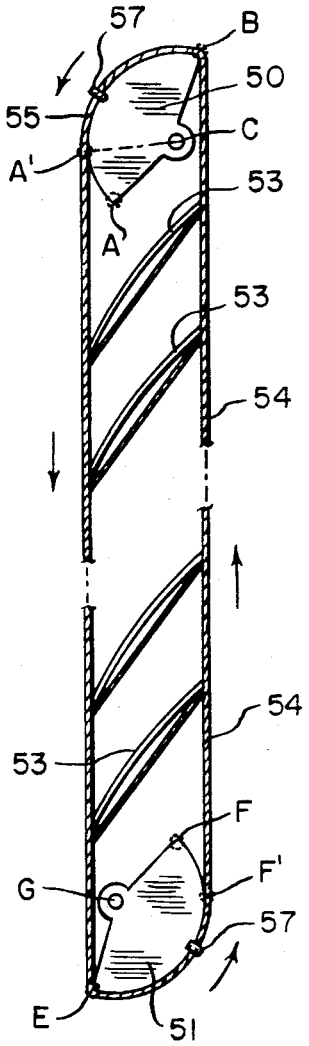
FIG. 6 is a sketch similar to FIG. 5 showing the slats in a tilted unstabilized position.

A further embodiment of the invention, as shown in FIGS. 5 and 6, utilizes a quadrant having an outer curved periphery which acts as a pivot means. In this construction quadrants 50 and 51 are pivotal about center points C and G of pivot axes extending parallel to a plurality of slats forming a mat. The slats are supported by a pair of cables 54 extending around the curved portion 55 of the quadrants and which are fixed thereto at points 57. The supporting points A and B of cables 54 on quadrant 50 and E and F on quadrant 51 are not fixed on the quadrants, but as shown in FIG. 6, will move depending on the direction and amount of rotation of the quadrants to new positions A′ and F′.

As with the construction of FIGS. 2 and 4, the supporting points and center point of the pivot axis of each quadrant forms a triangle having a top angle and two base angles with the top angles ACB and EGF pointing in opposite directions away from the mat of slats. Thus the blind arrangement will have a stabilized position in a slat closed position. This is because, as seen in FIG. 6, arc A′-B of quadrant 50 over which the cable extends is smaller than arc A-B over which the cable extends in FIG. 5. This results in a decrease in the amount of cable extending over the quadrant which decrease is added to the length of cable between A′ and E which in turn would effectively lengthen the cable between A′ and E reducing any tension therein. Similarly arc E-F′ of quadrant 52 is less than arc E-F thus resulting in an effective increase in length of cable between poiunts F′ and B reducing tension therein. Reduction in tension thus occurs when the slats in the embodiments of FIGS. 5 and 6 move towards a closed stabilized position and increases when a tilting force is applied to move the slats to an open position.

I claim:

1. A slatted blind assembly comprising a mat of tiltable slats including a first end slat on a first end of the mat and a second end slat on a second end of the mat opposite said first end, at least one pivot means positioned adjacent each said end of the mat adapted to be pivotally connected with respect to a structure and adapted to pivot about a pivot axis extending parallel to the slats and slat support means comprising pairs of cables connected to said pivot means, the cables of each pair running parallel on opposite sides of the slats in a plane perpendicular to the plane of the mat of slats, and each said pair supporting said slats from two supporting points on each said pivot means, said pairs of cables extending between the pivot means situated at opposite ends of the mat whereby pivotal movement of a pivot means about a pivot axis will cause each of the slats to tilt; whereby, with each pivot means, the two supporting points and a center point of the pivot axis form the vertices of a triangle with the center point forming the top vertex of the triangle and the two supporting points forming the base vertices of the triangle and with the top vertices of the triangles of the two pivot means being situated at opposite ends of the mat of slats and pointed in opposite directions whereby tension in the cables is at a minimum in one or more stabilized tilt positions of the slats and in any other tilt positions of the slats there is an increased tension in the cables tending to return the slats to a stabilized position.

2. A slatted blind assembly according to claim 1 characterized in that on at least one end of the mat said one pivot means comprises a plurality of single pivot members in combination with the end slat situated at said one end of the mat, whereby there is a direct contact between the said single pivot members and said end slat and the supporting points are situated at respective opposite longitudinal edges of the end slat.

3. A slatted blind assembly according to claim 2 characterized in that a pair of cables is associated with each of said single pivot members at each end of the mat of slats.

4. A slatted blind assembly according to claim 1 characterized in that on at least one end of the mat at least one pivot means comprises a single pivot member remote and spaced from an adjacent end slat, in that the supporting points are formed by contacting points of the cables of a pair with the pivot member and in that there is a plurality of said single pivot members arranged on said one end of the mat each operating with a pair of cables.

5. A slatted blind assembly according to claim 4 characterized in that the distance between two supporting points on a pivot means when the slats are in fully open position is substantially equal to the width of a slat.

6. A slatted blind assembly according to claim 4 characterized in that there is a plurality of said single pivot members arranged on said second end of the mat remote and spaced from an adjacent end slat and in that a pair of cables is associated with a pivot member at each end of the mat.

7. A slatted blind assembly according to claim 1 characterized in that the top vertices point away from the mat of slats and whereby the stabilized position comprises a slat open position.

8. A slatted blind assembly according to claim 1 characterized in that the top vertices point towards the middle of the mat of slats and whereby the stabilized position comprises a slat closed position.

* * * * *